US007073219B2

(12) United States Patent
Poulin et al.

(10) Patent No.: US 7,073,219 B2
(45) Date of Patent: Jul. 11, 2006

(54) SIDE RAIL, HOSPITAL BED INCLUDING THE SAME, METHOD OF OPERATING ASSOCIATED THERETO AND KIT FOR ASSEMBLING THE SIDE RAIL

(75) Inventors: Stéphan Poulin, Saint-Rédempteur (CA); Christian Gauvin, Saint-Rédempteur (CA); Florimond Laporte, Québec (CA); Bruno LaVerdière, St-Lazare Bellechasse (CA); Vincent Rochette, Lévis (CA); Jean Rodrigue, Neuville (CA)

(73) Assignee: Teknion Concept, Levis (CA)

( * ) Notice: Subject to any disclaimer, the term of this patent is extended or adjusted under 35 U.S.C. 154(b) by 0 days.

(21) Appl. No.: 10/751,468

(22) Filed: Jan. 6, 2004

(65) Prior Publication Data

US 2005/0144720 A1 Jul. 7, 2005

(51) Int. Cl.
*A61G 7/18* (2006.01)

(52) U.S. Cl. ..... 5/425; 5/426; 5/428; 5/430

(58) Field of Classification Search ..... 5/425–426, 5/428–430

See application file for complete search history.

(56) References Cited

U.S. PATENT DOCUMENTS

| | | | | |
|---|---|---|---|---|
| 1,840,259 | A | 1/1932 | Schmohl | |
| 3,093,839 | A | 6/1963 | Higgins | |
| 3,336,609 | A | 8/1967 | Taylor | |
| 3,506,989 | A | 4/1970 | Ross et al. | 5/331 |
| 3,932,903 | A | 1/1976 | Adams et al. | 5/100 |
| 3,958,283 | A | 5/1976 | Adams et al. | 5/66 |
| 4,345,344 | A | 8/1982 | Gadoury et al. | 5/62 |
| 4,463,463 | A | 8/1984 | Kaneko | 5/68 |
| 4,509,217 | A | 4/1985 | Therrien | 5/430 |
| 4,747,171 | A | 5/1988 | Einsele et al. | 5/425 |
| 5,063,623 | A | 11/1991 | Bathrick et al. | 5/67 |
| 5,394,580 | A | 3/1995 | Foster et al. | 5/620 |
| 5,604,942 | A | 2/1997 | Allevato et al. | 5/428 |
| 5,689,839 | A | 11/1997 | Laganière et al. | 5/425 |
| 5,732,423 | A | 3/1998 | Weismiller et al. | 5/425 |
| 5,802,636 | A | 9/1998 | Corbin et al. | 5/425 |
| 6,038,721 | A | 3/2000 | Gordon | 5/663 |

(Continued)

FOREIGN PATENT DOCUMENTS

CA 1223702 7/1987

(Continued)

*Primary Examiner*—Patricia L. Engle
*Assistant Examiner*—Fredrick Conley
(74) *Attorney, Agent, or Firm*—Baker & Hostetler LLP

(57) ABSTRACT

A side rail; a patient support assembly, such a hospital bed, a stretcher and the like, provided with such a side rail; a method of operating associated thereto; and a kit for assembling the side rail. The side rail includes support bars and at least one cross bar being substantially positioned within a same vertical plane, substantially parallel to a corresponding side portion of the assembly. The support bars are rotatable with respect to the corresponding side portion about respective axes being parallel to a transverse axis of the assembly, and first and second ends of the at least one cross bar are rotatable with respect to the support bars about respective axes being parallel to the transverse axis, so that the side rail be operated between raised and lowered configurations along the same vertical plane and so that the side rail be collapsible in the lowered configuration, within the same vertical plane. The side rail is devised so as to be easily installed onto the assembly, and further devised so as to be easily, quickly and safely operated between the raised and lowered configurations.

17 Claims, 8 Drawing Sheets

U.S. PATENT DOCUMENTS

| | | | | |
|---|---|---|---|---|
| 6,163,904 | A | 12/2000 | Royston | 5/618 |
| 6,219,864 | B1 | 4/2001 | Ellis et al. | 5/600 |
| 6,389,622 | B1 * | 5/2002 | Her et al. | 5/600 |
| 6,393,641 | B1 | 5/2002 | Hensley | 5/618 |
| 6,396,224 | B1 | 5/2002 | Luff et al. | 318/16 |
| 6,397,416 | B1 | 6/2002 | Brooke et al. | 5/682 |
| 6,486,792 | B1 | 11/2002 | Moster et al. | 340/825.19 |
| 6,499,162 | B1 | 12/2002 | Lu | 5/618 |
| 6,519,794 | B1 | 2/2003 | Aarestad et al. | 5/430 |
| 6,560,492 | B1 | 5/2003 | Borders | 700/17 |
| 6,564,404 | B1 | 5/2003 | Nanahara | 5/430 |
| 6,640,360 | B1 | 11/2003 | Hornbach et al. | 5/425 |
| 2002/0095724 | A1 | 7/2002 | Hornbach et al. | 5/425 |
| 2002/0144350 | A1 | 10/2002 | Shih | 5/620 |
| 2003/0051291 | A1 | 3/2003 | Brooke et al. | 5/430 |
| 2003/0093860 | A1 | 5/2003 | Kramer et al. | 5/600 |
| 2003/0106151 | A1 | 6/2003 | Nanahara | 5/430 |
| 2003/0167568 | A1 | 9/2003 | Brooke | 5/430 |

FOREIGN PATENT DOCUMENTS

| | | |
|---|---|---|
| CA | 1227389 | 9/1987 |
| CA | 1227907 | 10/1987 |
| CA | 1240806 | 8/1988 |
| CA | 1247805 | 1/1989 |
| CA | 1254704 | 5/1989 |
| CA | 1255453 | 6/1989 |
| CA | 1259453 | 9/1989 |
| CA | 1266752 | 3/1990 |
| CA | 1275433 | 10/1990 |
| CA | 1279443 | 1/1991 |
| CA | 1294576 | 1/1992 |
| CA | 1308626 | 10/1992 |
| CA | 1308866 | 10/1992 |
| CA | 2045308 | 12/1992 |
| CA | 2107057 | 4/1994 |
| CA | 2145851 | 4/1994 |
| CA | 2020880 | 5/1994 |
| CA | 2085866 | 6/1994 |
| CA | 1332652 | 10/1994 |
| CA | 2172397 | 3/1995 |
| CA | 2051841 | 7/1995 |
| CA | 1336783 | 8/1995 |
| CA | 2185530 | 9/1995 |
| CA | 2122515 | 10/1995 |
| CA | 2122686 | 11/1995 |
| CA | 2189046 | 11/1995 |
| CA | 2164028 | 10/1996 |
| CA | 2193612 | 6/1997 |
| CA | 2193613 | 6/1997 |
| CA | 2242320 | 6/1997 |
| CA | 2176064 | 11/1997 |
| CA | 2181021 | 1/1998 |
| CA | 2234903 | 10/1998 |
| CA | 2223851 | 11/1998 |
| CA | 2296497 | 2/1999 |
| CA | 2308324 | 5/1999 |
| CA | 2327361 | 10/1999 |
| CA | 2329185 | 11/1999 |
| CA | 2331806 | * 12/1999 |
| CA | 2175608 | 3/2000 |
| CA | 2055672 | 4/2000 |
| CA | 2348553 | 6/2000 |
| CA | 2258197 | 7/2000 |
| CA | 2364064 | 9/2000 |
| CA | 2192033 | 10/2000 |
| CA | 2366551 | 11/2000 |
| CA | 2055671 | 1/2001 |
| CA | 2145982 | 7/2001 |
| CA | 2120312 | 9/2001 |
| CA | 2403379 | 9/2001 |
| CA | 2348826 | 11/2001 |
| CA | 2408342 | 11/2001 |
| CA | 2422823 | 4/2002 |
| CA | 2394754 | 6/2002 |
| CA | 2042768 | 8/2002 |
| CA | 2337994 | 8/2002 |
| CA | 2321297 | 10/2002 |
| DE | 29705820 | 5/1997 |
| FR | 2647654 | 12/1990 |
| WO | WO 03/015686 | 2/2003 |

* cited by examiner

SIDE RAIL, HOSPITAL BED INCLUDING THE SAME, METHOD OF OPERATING ASSOCIATED THERETO AND KIT FOR ASSEMBLING THE SIDE RAIL

FIELD OF THE INVENTION

The present invention relates to a side rail such as the ones employed with hospital beds and the like, being operable between a raised configuration for containing a patient inside the hospital bed, and a lowered configuration for allowing egress of the patient from said bed. More particularly, the present invention relates to a side rail devised so as to be easily installed onto a patient support assembly, such as a hospital bed, and further devised so as to be easily, quickly and safely operated between raised and lowered configurations. The present invention also relates to a hospital bed provided with a least one of such side rail, to a method of operating each side rail, as well as to a kit for assembling the side rail.

BACKGROUND OF THE INVENTION

Patient support assemblies, such as hospital beds, stretchers and the like, as well as the various devices used therewith, such as side rails for instance, etc., are very well known in the art.

Known to the Applicant are the following Canadian patents and patent applications which describe different patient support assemblies, such as hospital beds, stretchers and the like, as well as the various devices used therewith: 1,223,702; 1,227,389; 1,227,907; 1,240,806; 1,247,805; 1,254,704; 1,255,453; 1,259,453; 1,266,752; 1,275,433; 1,279,443; 1,294,576; 1,308,626; 1,308,866; 1,332,652; 1,336,783; 2,020,880; 2,042,768; 2,045,308; 2,051,841; 2,055,671; 2,055,672; 2,085,866; 2,107,057; 2,120,312; 2,122,515; 2,122,686; 2,145,851; 2,145,982; 2,164,028; 2,172,397; 2,175,608; 2,176,064; 2,181,021; 2,185,530; 2,189,046; 2,192,033; 2,193,612; 2,193,613; 2,223,851; 2,234,903; 2,242,320; 2,258,197; 2,296,497; 2,308,324; 2,321,297; 2,327,361; 2,329,185; 2,331,806; 2,337,994; 2,348,553; 2,348,826; 2,364,064; 2,366,551; 2,394,754; 2,403,379; 2,408,342; and 2,422,823.

Also known to the Applicant are the following US patents and patent applications which also describe different patient support assemblies, such as hospital beds, stretchers and the like, as well as the various devices used therewith: U.S. Pat. Nos. 3,506,989; 3,932,903; 3,958,283; 4,345,344; 4,463,463; 4,509,217; 4,747,171; 5,063,623; 5,394,580; 5,604,942; 5,689,839; 5,732,423; 5,802,636; 6,038,721; 6,163,904; 6,219,864 B1; 6,389,622 B1; 6,393,641 B1; 6,396,224 B1; 6,397,416 B2; 6,486,792 B1; 6,499,162 B1; 6,519,794 B1; 6,560,492 B2; 6,564,404 B1; 6,640,360 B2; 2002/0095724 A1; 2002/0144350 A1; 2003/0051291 A1; 2003/0093860 A1; 2003/0106151 A1; and 2003/0167568 A1.

A significant problem associated with some of the side rails used with the above-mentioned prior art assemblies is that they are constructed in a very complex manner making them difficult to assemble and/or install onto a corresponding patient support assembly, such as a hospital bed for example, and also making them very cumbersome and unsafe to operate between raised and lowered configurations.

Another significant problem associated with some of the side rails of the above-mentioned prior art assemblies is that as a result of their bulky design, the side rails when operated from a raised to a lowered configuration often need to be deployed or swiveled outwardly from the sides of the hospital bed, in a direction transverse to the bed itself, that is, taking up a great radius of operation curvature, thereby requiring the operator of the side rails to be positioned at a substantial distance from the bed, which is disadvantageous for obvious reasons known in the art.

Another significant problem associated with some of the side rails of the above-mentioned prior art assemblies is that for most side rails, when operated into the lowered configurations, they are swiveled and/or lowered to the bottom side portion of the bed, thus taking up and blocking a lot of the space normally accessible beneath the patient support platform, thereby preventing an operator of the bed from positioning equipment therein and/or enabling the base structures of neighboring accessories, such as a wheeled base of a side tray for example, to be positionable under the patient support platform due to the presence of the side rails when in the lowered configuration.

Another significant problem associated with some of the side rails of the above-mentioned prior art assemblies is that due to their inherently complex construction and design, their components cannot easily be modified to adapt themselves to the ongoing changes in the governmental guidances and standards for the assessment and implementation of bed rails.

Another significant problem associated with some of the side rails of the above-mentioned prior art assemblies is that due to their inherently complex design and construction, the operation of individual side rails, and/or pair of side rails may pose unwanted hazards to patient safety, particularly in regards to the risk for entrapment, which is very undesirable for obvious reasons. This holds particularly true for the population at risk for entrapment which are generally patients who are frail or elderly or those who have conditions such as agitation, delirium, confusion, pain, uncontrolled body movement, and the like. It has been found that the risk of entrapment generally increased due to technical issues regarding to bed rails and other components of patient support assemblies, such as hospital beds and the like.

Therefore, in view of the above, there is a definite need for an improved side rail which, by virtue of its design and components, would be able to overcome some of the aforementioned prior art problems.

SUMMARY OF THE INVENTION

The object of the present invention is to provide a side rail which would overcome some of the above-mentioned problems and which would thus be an improvement over other related side rails, devices, and/or assemblies known in the prior art.

In accordance with the present invention, the above object is achieved with a side rail for mounting onto a patient support assembly, the patient support assembly having a longitudinal x-axis, a transversal y-axis and a vertical z-axis, said axes being mutually orthogonal to each other, the x-axis extending longitudinally along the patient support assembly, from a front portion of the assembly to an opposite rear portion thereof, the y-axis extending transversally across the patient support assembly, from a left side portion of the assembly to an opposite right side portion thereof, and the z-axis extending vertically along the patient support assembly, from a bottom portion of the assembly to an opposite top portion thereof, the side rail extending substantially along the x-axis of the patient support assembly, the side rail being operatively mountable onto a corresponding side portion of the patient support assembly, the side rail comprising:

a first support bar having upper and lower ends, the lower end of the first support bar being pivotally mountable to said corresponding side portion of the patient support assembly;

a second support bar having upper and lower ends, the lower end of the second support bar being pivotally mountable to said corresponding side portion of the patient support assembly; and at least one cross bar having first and second ends pivotally connected to the first and second support bars respectively;

the side rail being operable between a raised configuration where the at least one cross bar is above a segment of the patient support assembly for preventing egress of a patient from said assembly, and a lowered configuration where said at least one cross bar is below said segment of the patient support assembly for allowing egress of the patient from the assembly;

wherein the support bars and the at least one cross bar of the side rail are substantially positioned within a same vertical plane, being substantially parallel to the corresponding side portion of the patient support assembly, and wherein the first and second support bars are rotatable with respect to said corresponding side portion about respective axes being parallel to the y-axis, and the first and second ends of the at least one cross bar are rotatable with respect to the support bars about respective axes being parallel to the y-axis, so that the side rail be operated between the raised and lowered configurations along said same vertical plane and so that the side rail be collapsible in the lowered configuration, within said same vertical plane.

Preferably, the side rail comprises a pivot bar having first and second ends, the first end of the pivot bar being pivotally mountable about said corresponding side portion of the patient support assembly and being rotatable thereabout about an axis parallel to the y-axis, and the second end of the pivot bar being pivotally connected to the lower end of the second support bar and being rotatable. thereabout about an axis parallel to the y-axis, the pivot bar being shaped, positioned and dimensioned so as to prevent the side rail from exceeding a predetermined distance longitudinally along the patient support assembly when operated and collapsed into the lowered configuration.

Preferably also, the lower end of the first support bar is provided with blocking means cooperable with the patient support assembly, and operable between a blocking configuration where the blocking means are engaged with the assembly and maintain the side rail in a raised configuration, and a release configuration where the blocking means are disengaged from the assembly for allowing the side rail to be operated into a lowered configuration.

According to another aspect of the invention, there is also provided a hospital bed having a longitudinal x-axis, a transversal y-axis and a vertical z-axis, said axes being mutually orthogonal to each other, the x-axis extending longitudinally along the hospital bed, from a front portion of the bed to an opposite rear portion thereof, the y-axis extending transversally across the hospital bed, from a left side portion of the bed to an opposite right side portion thereof, and the z-axis extending vertically along the hospital bed, from a bottom portion of the bed to an opposite top portion thereof, the hospital bed comprising:

a base structure extending substantially along the x-axis of the hospital bed, the base frame being movable along at least one of said axes;

a patient support platform also extending substantially along the x-axis of the hospital bed, the patient support platform being operatively connected onto the base structure for receiving a patient thereon and having sections movable about at least one of said axes for assuming different configurations; and at least one side rail also extending substantially along the x-axis of the hospital bed, each side rail being operatively mounted onto a corresponding side portion of the hospital bed, each side rail comprising:

a first support bar having upper and lower ends, the lower end of the first support bar being pivotally mounted to said corresponding side portion of the hospital bed;

a second support bar having upper and lower ends, the lower end of the second support bar being pivotally mounted to said corresponding side portion of the hospital bed; and at least one cross bar having first and second ends pivotally connected to the first and second support bars respectively;

each side rail being operable between a raised configuration where the at least one cross bar is above a segment of the patient support platform for preventing egress of the patient from said platform, and a lowered configuration where said at least one cross bar is below said segment of the patient support platform for allowing egress of the patient from the platform;

wherein the support bars and the at least one cross bar of each side rail are substantially positioned within a same vertical plane, being substantially parallel to the corresponding side portion of the hospital bed, and wherein the first and second support bars are rotatable with respect to said corresponding side portion about respective axes being parallel to the y-axis, and the first and second ends of the at least one cross bar are rotatable with respect to the support bars about respective axes being parallel to the y-axis, so that each side rail be operated between the raised and lowered configurations along said same vertical plane and so that said each side rail be collapsible in the lowered configuration, within said same vertical plane.

According to another aspect of the invention, there is also provided a method of operating a side rail of a hospital bed, the method comprising the steps of:

a) providing the hospital bed described and illustrated herein, with the at least one side rail being in the raised configuration;

b) pulling on the knob for operating the blocking means into a release configuration; and c) rotating the support bars of the at least one side rail within said same vertical plane so as to operate and collapse said at least one side rail into the lowered configuration.

According to another aspect of the invention, there is also provided a method of operating a side rail of a hospital bed, the method comprising the steps of:

a) providing the hospital bed described and illustrated herein, with the at least one side rail being in the lowered configuration; and b) rotating the support bars of the at least one side rail within said same vertical plane until triggering the blocking means into a blocking configuration so as to operate said at least one side rail into the raised configuration.

According to yet another aspect of the invention, there is also provided a kit for assembling a side rail for mounting onto a patient support assembly having a longitudinal x-axis, a transversal y-axis and a vertical z-axis, said axes being mutually orthogonal to each other, the x-axis extending longitudinally along the patient support assembly, from a front portion of the assembly to an opposite rear portion thereof, the y-axis extending transversally across the patient support assembly, from a left side portion of the assembly to an opposite right side portion thereof, and the z-axis extending vertically along the patient support assembly, from a bottom portion of the assembly to an opposite top portion thereof, the kit comprising:

a first support bar having upper and lower ends, the lower end of the first support bar being pivotally mountable to said corresponding side portion of the patient support assembly;

a second support bar having upper and lower ends, the lower end of the second support bar being pivotally mountable to said corresponding side portion of the patient support assembly; and at least one cross bar having first and second ends pivotally connectable to the first and second support bars respectively;

once assembled, the side rail extending substantially along the x-axis of the patient support assembly, the side rail being operatively mounted onto a corresponding side portion of the patient support assembly and being operable between a raised configuration where the at least one cross bar is above a segment of the patient support assembly for preventing egress of a patient from said assembly, and a lowered configuration where said at least one cross bar is below said segment of the patient support assembly for allowing egress of the patient from the assembly;

wherein the support bars and the at least one cross bar of each side rail are substantially positioned within a same vertical plane, being substantially parallel to the corresponding side portion of the patient support assembly, and wherein the first and second support bars are rotatable with respect to said corresponding side portion about respective axes being parallel to the y-axis, and the first and second ends of the at least one cross bar are rotatable with respect to the support bars about respective axes being parallel to the y-axis, so that the side rail be operated between the raised and lowered configurations along said same vertical plane and so that the side rail be collapsible in the lowered configuration, within said same vertical plane.

The objects, advantages and other features of the present invention will become more apparent upon reading of the following non-restrictive description of preferred embodiments thereof, given for the purpose of exemplification only with reference to the accompanying drawings.

DETAILED DESCRIPTION OF PREFERRED EMBODIMENTS OF THE INVENTION

In the following description, the same numerical references refer to similar elements. The embodiments shown in the figures and the physical dimensions and materials which may be suggested herein are preferred embodiments only.

Moreover, although the present invention was primarily designed for use with a hospital bed, it may be used with other types of beds, patient support assemblies, and/or other objects and in other fields, as apparent to a person skilled in the art. For this reason, expressions such as "hospital", "bed", "patient", etc., used herein should not be taken as to limit the scope of the present invention and includes all other kinds of patient support assemblies (e.g. stretchers, etc.) and/or items with which the present invention could be used and may be useful, as apparent to a person skilled in the art.

Moreover, in the context of the present invention, the expressions "assembly", "bed", "structure", and/or "device", as well as any other equivalent expressions and/or compound words thereof, may be used interchangeably, as apparent to a person skilled in the art. Furthermore, the same applies for any other mutually equivalent expressions, such as "side rail", "bed rail" and "guide rail", as well as "patient" and "person" for example, as also apparent to a person skilled in the art.

In addition, although the preferred embodiment of the present invention as illustrated in the accompanying drawings comprises various components, such as a pivot bar, a plurality of cross bars, a spring, a knob, pins, etc., and although the preferred embodiment of the side rail 1 and corresponding patient support assembly 3 (e.g. hospital bed) as shown consists of certain geometrical configurations as explained and illustrated herein, not all of these components and geometries are essential to the invention and thus should not be taken in their restrictive sense, i.e. should not be taken as to limit the scope of the present invention. It is to be understood, as also apparent to a person skilled in the art, that other suitable components and cooperations thereinbetween, as well as other suitable geometrical configurations may be used for the side rail 1 and corresponding parts according to the present invention, as briefly explained herein and as inferred herefrom, without departing from the scope of the invention.

Broadly described, the present invention, as shown in the accompanying drawings, relates a side rail 1 such as the ones employed with hospital beds, stretchers and the like, being operable between a raised configuration for containing a patient (not shown) inside the hospital bed, and a lowered configuration for allowing egress of the patient from said bed.

Figure 1:
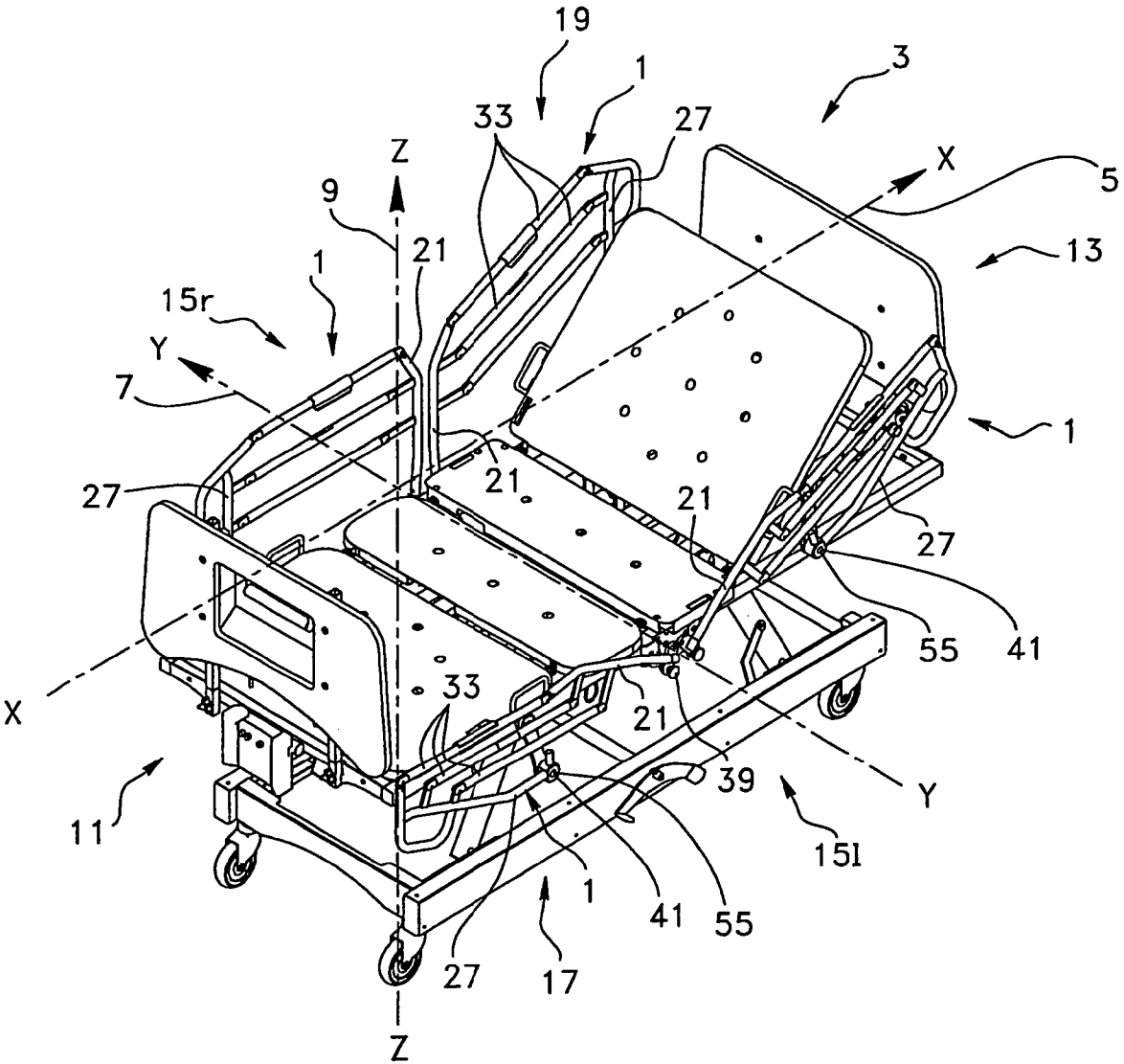
FIG. 1 is a top perspective view of a hospital bed comprising a plurality of side rails according to a first preferred embodiment of the present invention.

As better shown in FIG. 1, the side rail 1 is mounted onto a patient support assembly 3 (whether a hospital bed, a stretcher, and/or the like). The patient support assembly 3 has a longitudinal x-axis 5, a transversal y-axis 7 and a vertical z-axis 9, said axes 5, 7, 9 being mutually orthogonal to each other. The x-axis 5 extends longitudinally a long the patient support assembly 3, from a front portion 11 of the assembly 3 to an opposite rear portion 13 thereof. The y-axis 7 extends transversally across the patient support assembly 3, from a left side portion 15*l* of the assembly 3 to an opposite right side portion 15*r* thereof. The z-axis 9 extends vertically along the patient support assembly 3, from a bottom portion 17 of the assembly 3 to an opposite top portion 19 thereof. As can be easily understood, the above-mentioned axis are imaginary axis and are mainly used herein for facilitating the purpose of referencing.

According to the preferred embodiment of the present invention, as illustrated in FIG. 1, the patient support assembly 3 preferably consists of a hospital bed, and this hospital bed preferably comprises a base structure, and a patient support platform. As shown, the base structure preferably extends substantially along the y-axis of the hospital bed, and is moveable along at least one of the axes 5, 7, 9, by means of suitable links and actuators, as is well known in the prior art. Moreover, the patient support platform also preferably extends substantially along the y-axis of the hospital bed and is preferably operatively connected onto the base structure for receiving a patient thereon, as can be easily understood from FIG. 1. As is customary with most articulated patient support platforms known in the art, the platform of the hospital bed according to the present invention preferably comprises various sections which are moveable about at least one of said axis for assuming different configurations, examples of which are the following: Trendelenburg position, reverse Trendelenburg position, respiratory position, cardio chair position, raised leg section position, raised head section position, sleep surface elevation, and neutral position.

Moreover, the base structure as also shown in FIG. 1 may be provided with suitable casters, with corresponding steering and/or braking assembly, for suitably displacing the hospital bed from one location to another. The different components and features which could be used for the base structure and the patient support platform are very well known in the art. Moreover, it is worth mentioning at this point that according to the present invention, the base structure is not considered an essential component of the present invention for the side rail may be properly operated along a patient support assembly not provided with a base structure, as apparent to a person skilled in the art.

Figure 3A:
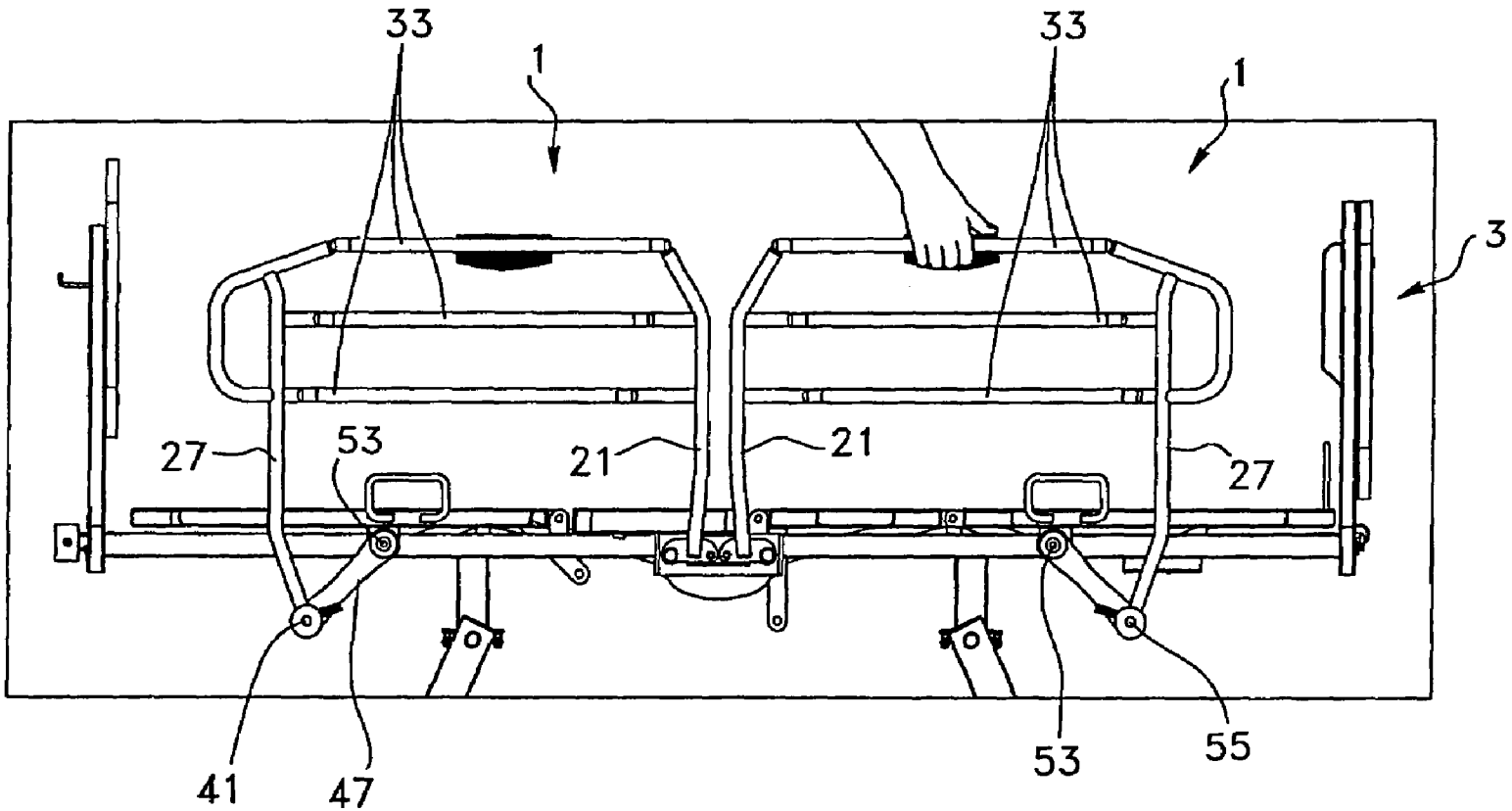
FIGS. 3*a*–3*e* are front plan views describing a preferred sequential operation of a side rail according to a preferred embodiment of the present invention.
Figure 3B:
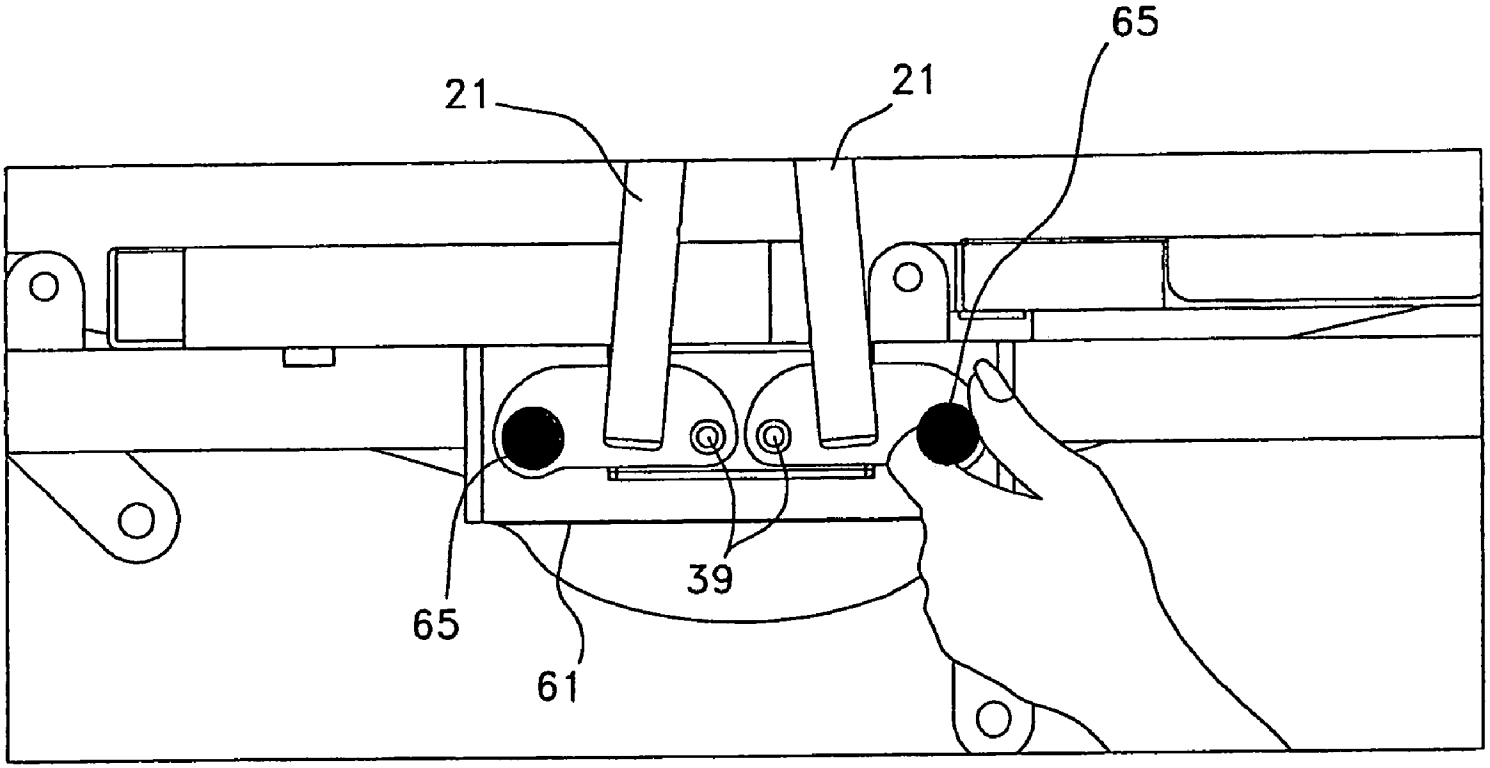
Figure 3C:
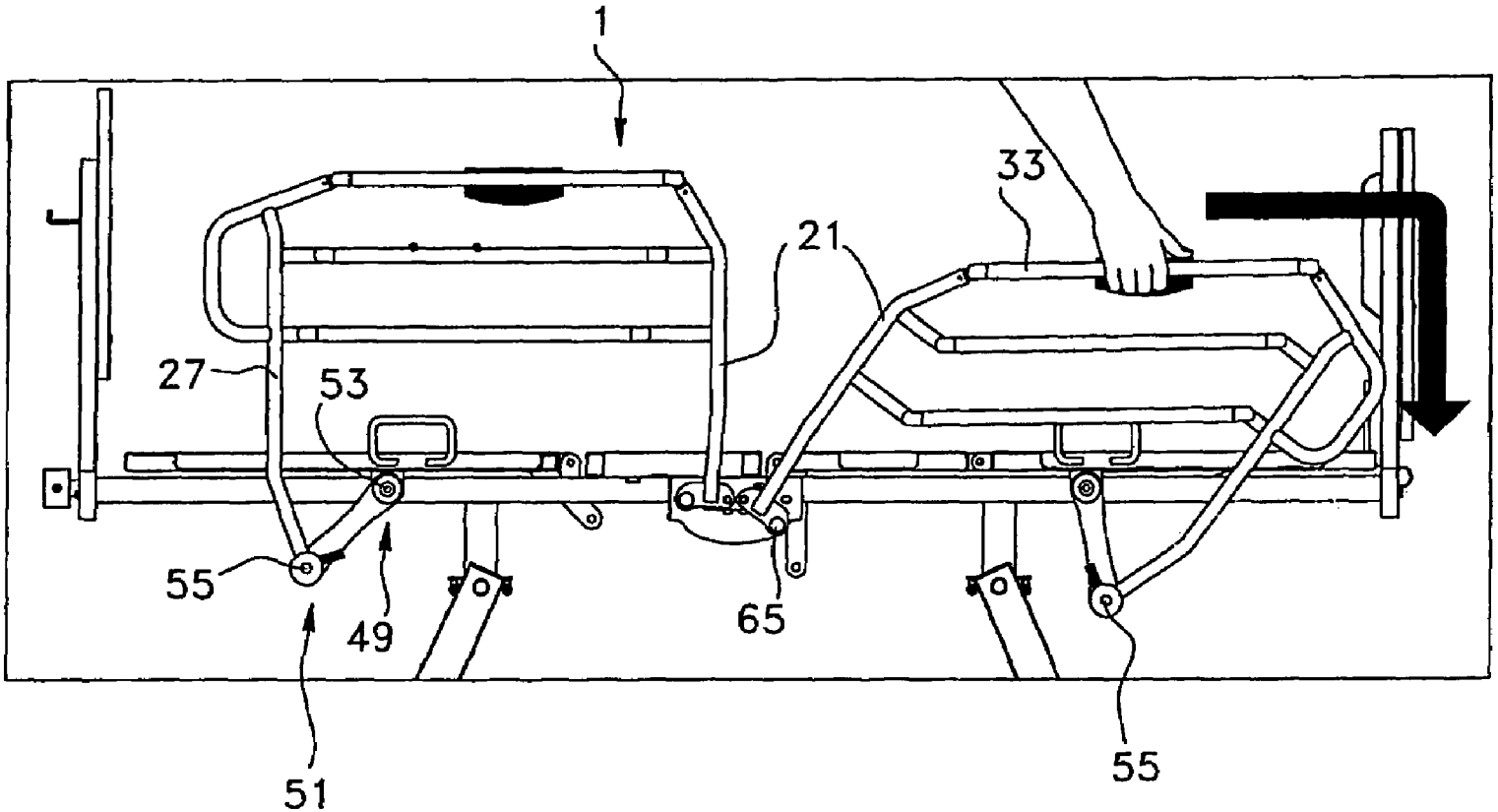
Figure 3D:
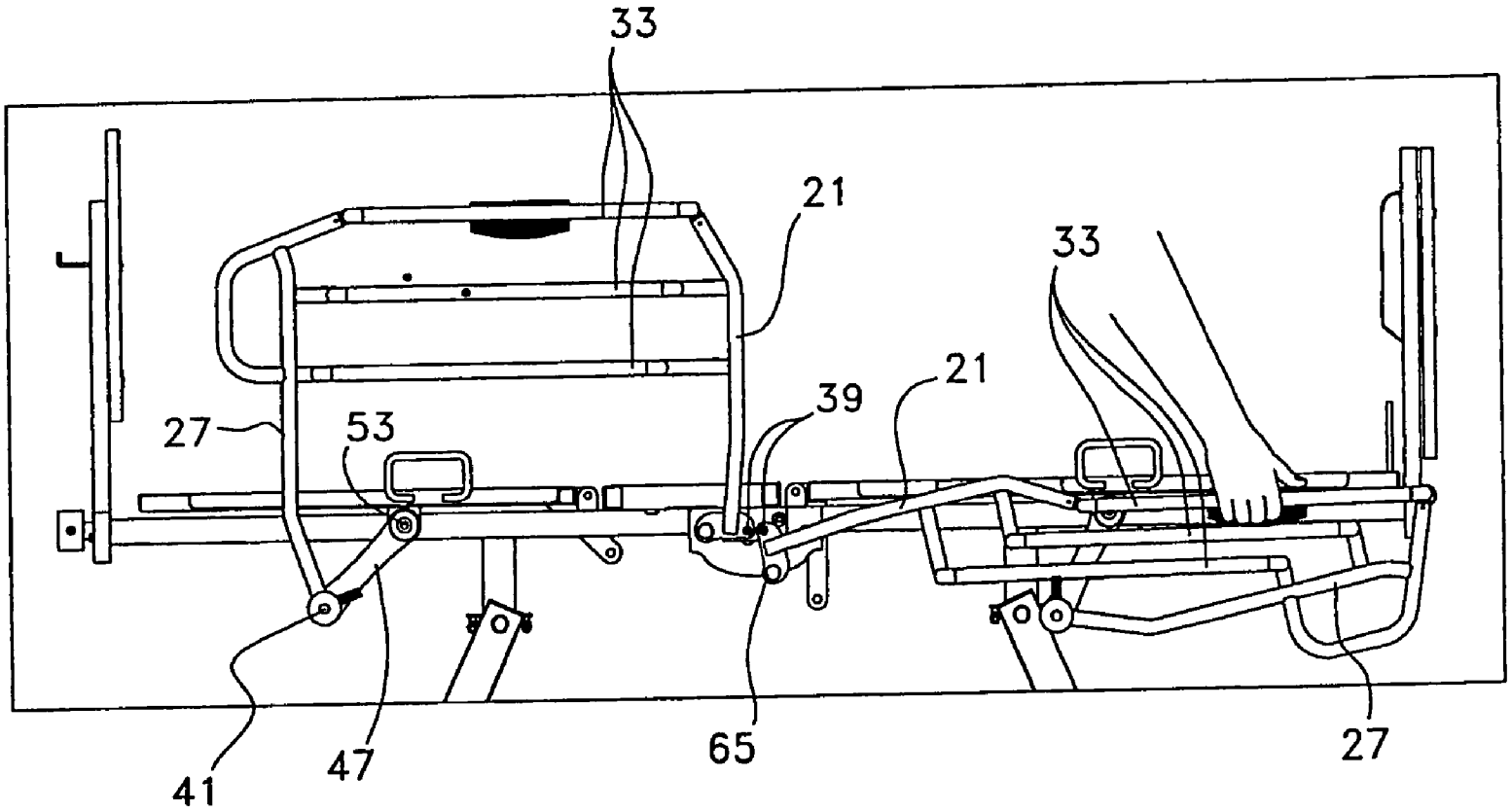
Figure 3E:
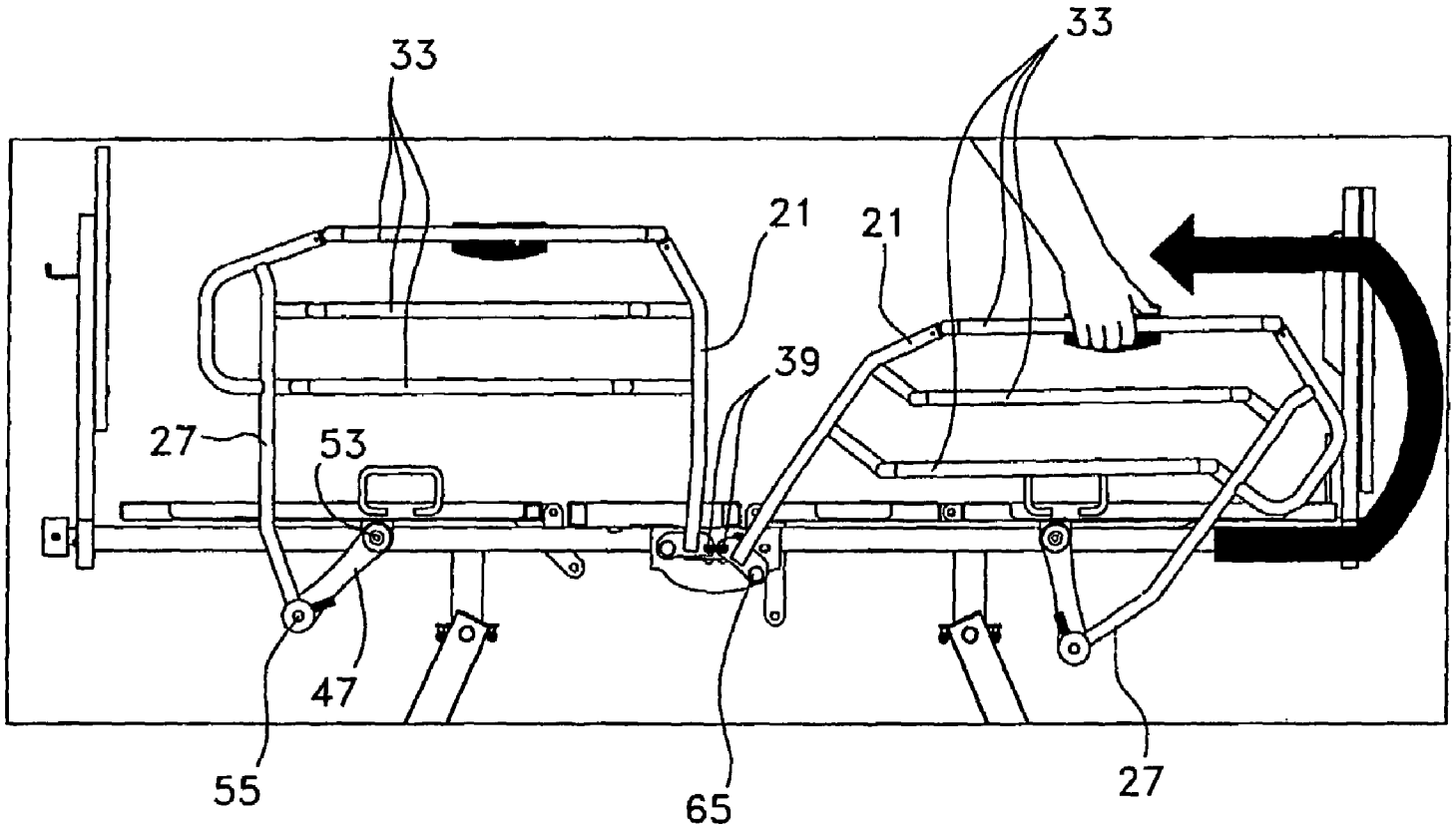
Figure 4:
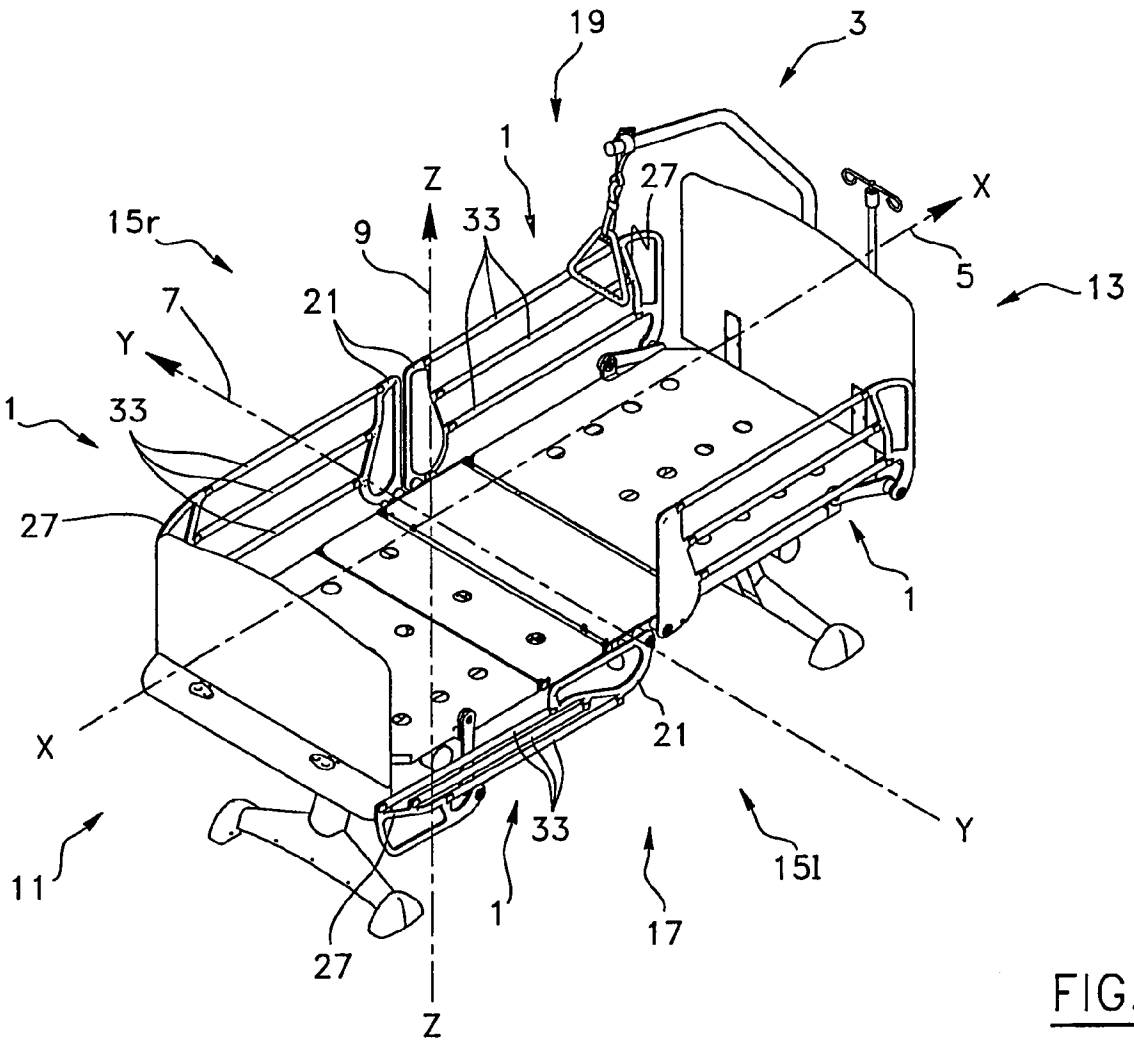
FIG. 4 is a top perspective view of a hospital bed comprising a plurality of side rails according to another preferred embodiment of the present invention, the hospital bed being shown with an accessory mounted to the rear portion thereof.

As better shown in FIGS. 1, 3 and 4, the side rail 1 extends substantially along the x-axis 5 of the patient support assembly 3 and is operatively mountable onto a corresponding side portion 15 of the patient support assembly 3. According to the present invention, each side rail 1 comprises a first support bar 21 having upper and lower ends 23, 25, the lower end 25 of the first support bar 21 being pivotally mountable to said corresponding side portion 15 of the patient support assembly 3; a second support bar 27 having upper and lower ends 29, 31, the lower end 31 of the second support bar 27 being pivotally mountable to said corresponding side portion 15 of the patient support assembly 3; and at least one cross bar 33 having first and second ends 35, 37 pivotally connected to the first and second support bars 21, 27 respectively, as can be more easily understood when referring to FIG. 2.

As better shown in FIGS. 3*a*–3*e*, the side rail 1 is operable between a raised configuration where the at least one cross bar 33 is above a segment of the patient support assembly 3 for preventing egress of the patient from the assembly 3, and a lowered configuration where said at least one cross bar 33 is below said segment of the patient support assembly 3 for allowing egress of the patient from the assembly 3. An important feature of the present invention resides in that the support bars 21, 27 and the at least one cross bar 33 of the side rail 1 are substantially positioned within a same vertical plane, being substantially parallel to the corresponding side portion 15 of the patient support assembly 3, and that the first and second support bars 21, 27 are rotatable with respect to said corresponding side portion 15 about respective axes 39, 41 being parallel to the y-axis 7, and the first and second ends 35, 37 of the at least one cross bar 33 are rotatable with respect to the support bars 21, 27 about respective axes 43, 45 being parallel to the y-axis 7, so that the side rail 1 be operated between the raised and lowered configurations along said same vertical plane and so that the side rail 1 be collapsible in the lowered configuration, within said same vertical plane, as better shown in FIG. 3*d*. These components and corresponding features enable mainly the side rail 1 to be easily, quickly and safely operated between raised and lowered configurations, without requiring an operator of the side rail 1 to be positioned at a certain distance from the patient support assembly 3, as is the case with conventional side rails. Moreover, as can be appreciated from FIG. 3*d*, the side rail 1 when in the lowered configuration takes very little space due to its collapsible nature, thereby allowing an operator of the assembly 3 to have access to underneath the patient support platform and/or for a patient to be seated comfortably thereon.

Figure 2:
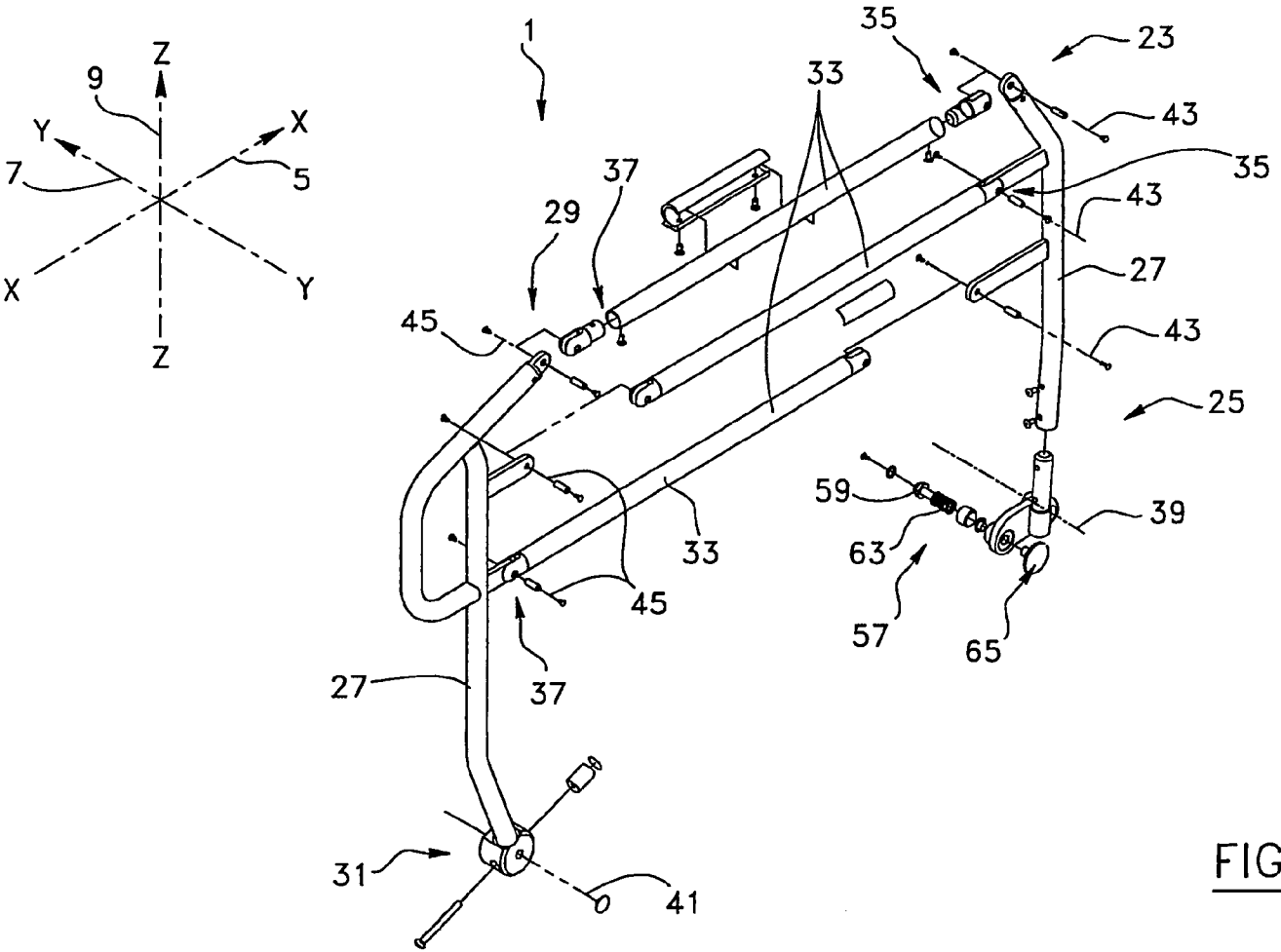
FIG. 2 is an exploded view of the components of one of the side rails shown in FIG. 1.

As better shown in FIG. 2, and as can also be easily understood therefrom, the different ends and portions of the support bars 21, 27 and cross bars 33 may be provided with suitable fasteners, joints, flanges, connectors, pins, hinges, coverings, and/or the like, in order to enable the side rail 1 to be easily, safely and smoothly operated between the raised and lowered configurations, and to be suitably collapsible (e.g. occupy a minimal space, be positioned conveniently along the patient support assembly 3, etc.) in the lowered configuration, as apparent to a person skilled in the art.

As also better shown in FIGS. 3*a*–3*e*, the side rail 1 comprises a pivot bar 47 having first and second ends 49, 51, the first end 49 of the pivot bar 47 being pivotally mountable about said corresponding side portion 15 of the patient support assembly 3 and being rotatable thereabout about an axis 53 parallel to the y-axis 7, and the second end 51 of the pivot bar 47 being pivotally connected to the lower end 31 of the second support bar 27 and being rotatable thereabout about an axis 55 parallel to the y-axis 7, the pivot bar 47 being shaped, positioned and dimensioned so as to prevent the side rail 1 from exceeding a predetermined distance longitudinally along the patient support assembly 3 when operated and collapsed into the lowered configuration. The provision of a pivot bar 47 in the manner described above enables namely the side rail 1 to not exceed beyond the front or rear portion of the hospital bed when in a lowered configuration, which is very desirable for various reasons known in the art, particularly in regards to guidance standards in terms of implementation of bed rails.

Preferably, and as better shown in FIG. 2, the lower end 25 of the first support bar 21 is provided with blocking means 57 cooperable with the patient support assembly 3, and operable between a blocking configuration where the blocking means 57 are engaged with the assembly 3 and maintain the side rail 1 in a raised configuration, as illustrated in FIG. 3*a*, and a release configuration where the blocking means 57 are disengaged from the assembly 3 for allowing the side rail 1 to be operated into a lowered configuration, as shown in FIGS. 3*c*–3*e*.

As also shown in FIG. 2, and when referring to FIG. 3*b*, the blocking means 57 preferably comprise a locking pin 59 having a first extremity insertable into a corresponding hole of an adjacent plate 61 of the assembly 3, the blocking means 57 being in a blocking configuration when the locking pin 59 is inserted into the hole of the plate 61, thereby preventing the first support bar 21 from being rotated about the corresponding side portion 15 of the patient support assembly 3, and the blocking means 57 being in the release configuration when the locking pin 59 is urged away from the hole of the plate 61, thereby enabling the first support bar 21 to be rotated about the corresponding side portion 15 of the patient support assembly 3, and to be operated into the lowered configuration.

Preferably, the blocking means 57 comprise biasing means 63 (e.g. a spring) operatively connected to the locking pin 59 for biasing the same into the hole of the plate 61. Preferably also, the blocking means 57 may comprise other suitable components, such as bearings, fasteners, etc., operatively connected to one another, in a suitable manner, as apparent to a person skilled in the art, for properly biasing the locking pin 59 in the hole of the plate 61, as well as damping components for example, for adjustably and/or controllably govern the rate of rotation (particularly, during lowering) of the side rail 1. It is worth mentioning that these components, although very advantageous, are not essential to the present invention.

Preferably also, the biasing means 63, locking pin 59 and plate 61 are positioned, shaped and sized with respect to one another to enable the blocking means 57 to be automatically triggered into the blocking configuration when the side rail 1 is operated back into the raised configuration from an intermediate configuration. This corresponds to the configuration illustrated in FIG. 3*a*.

As better shown in FIGS. 2 and 3*b*, the locking pin 59 has a second extremity, opposite to the first extremity, which is preferably provided with a knob 65 for enabling an operator of the assembly 3 to pull on said knob 65 for urging the locking pin 59 away from the hole of the plate 61.

In view of the above-described, and in accordance with the preferred embodiment of the present invention, when referring now to FIGS. 3*a*–3*b*, in order to operate the side rail 1, one must simply hold the upper cross bar 33 of the side rail 1 by the middle portion thereof, as better shown in FIG. 3*a*. Subsequently, as better shown in FIG. 3*b*, an operator must pull the locking pin 59 via the knob 65 of the blocking means 57 in order to release the same.

As shown in FIG. 3*c*, once the side rail 1 is free to move due to the releasing of the blocking means 57, the operator may pivot the side rail 1 easily and safety towards the outer portion of the bed until its lowered configuration is reached, the side rail 1 being devised to be pivoted along a same vertical plane, as described above. Once the side rail 1 is in its lowered configuration, as better shown in FIG. 3*d*, the side rail 1 may be raised once again simply by holding the upper cross bar 33 of the side rail 1 by the center preferably, as shown, and raising the side rail 1 by pivoting it towards the inside of the bed until the engagement of the locking pin 59 which is preferably done automatically and which triggers the blocking means 57 to maintain the side rail 1 in a raised configuration, as illustrated in FIG. 3*a*.

According to another aspect of the present invention, there is also provided a hospital bed provided with at least one side rail 1 such as the one described and illustrated herein. According to the preferred embodiment of the invention, as shown in FIG. 1, the at least one side rail 1 preferably comprises first and second pairs of side rails 1, the first pair of side rails 1 being operatively connected onto the left side portion 15*l* of the hospital bed, and the second pair of side rails 1 being operatively connected onto the right side portion 15*r* of the hospital bed, each pair of side rails 1 comprising first and second side rails 1, the first support bar 21 of each of the first and second side rails 1 being positioned substantially at a midpoint area along the bed and a constant distance being maintained between the first support bars 21 of said first and second side rails 1 when in the raised configuration, irrespectively of configuration assumed by the patient support platform. This particular feature enables namely to substantially reduce the risk of entrapment which easily occurs with conventional side rails.

According to another embodiment of the invention, the at least one side rail may simply comprises first and second side rails 1, the first side rail 1 being operatively connected onto the left side portion 15*l* of the hospital bed, and the second side rail 1 being operatively connected onto the right side portion 15*r* of the hospital bed. The first and second side rails 1 may be diametrically opposed to one another, so as to ensure a certain symmetry along the longitudinal axis 5 of the hospital bed, but may alternatively, if the particular applications of the bed intend it as such, the side rails 1 may be positioned diagonally opposed to one another.

As can be easily understood from the above-described, the preferred embodiment of the side rail 1 illustrated in the accompanying drawings is preferably intended for minimizing components and assembling steps, while providing a suitable side rail 1 for properly and selectively preventing and allowing egress of the patient from the hospital bed.

It is worth mentioning that according to another aspect of the present invention, there is also provided a method of operating the above-described side rail 1. Indeed, the method of operating a side rail 1 of a hospital bed, as schematically illustrated in FIGS. 3*a*–3*c*, preferably comprises the steps of a) providing a hospital bed such as the one described herein, with the at least one side rail 1 being in the raised configuration (see FIG. 3*a*); b) pulling on the knob 65 for operating the blocking means 57 into a released configuration (see FIG. 3*b*); and c) rotating the support bars 21, 27 of the at least one side rail 1 (e.g. via the cross bar 33) within said same vertical plane so as to operate in collapse said at least one side rail 1 into the lowered configuration (see FIGS. 3*c* and 3*d*). The reverse of the above-mentioned method of operating a side rail 1 of a hospital bed would preferably comprise the steps of a) providing the hospital bed with at least one side rail 1 being in the lowered configuration; and b) rotating the support bars 21, 27 of the at least one side rail 1 (e.g. via the same cross bar 33) within said same vertical plane until triggering the blocking means 57 into a blocking configuration so as to operate said at least one side rail 1 into the raised configuration.

Moreover, according to yet another aspect of the present invention, there is also provided a kit for assembling a side rail 1 and corresponding hospital bed such as the ones described and illustrated herein, as exemplified in FIGS. 1 to 4.

As may now be appreciated, the present invention is a substantial improvement over the prior art in that by virtue of its design and components, the side rail 1 according to the present invention may be easily installed onto a patient support assembly, such as a hospital bed, a stretcher and the like for example, and is devised so as to be easily, quickly and safely operated between raised and lowered configurations. Furthermore, the present invention is also advantageous in that, by virtue of its design and components, fewer components are required for achieving the same result as with conventional side rails, thus resulting in substantial savings. Moreover, the present invention is also advantageous in that the side rail 1 may be released from its blocking means simply by pulling the knob 65, so as to be rotated and operated between configurations, and may triggered back into a blocking configuration automatically when rotated back into a raised configuration. In addition, the present invention is also a substantial improvement over the prior art in that, by virtue of its design and components, a constant distance is maintained between the first support bars 21 of neighboring first and second side rails 1 when in the raised configuration, irrespectively of configuration assumed by the patient support platform, thereby substantially reducing the risk of entrapment for patients. Hence, in view of the above, it may now be appreciated that the present invention represents an important advantage over previous devices known in the prior art, in terms of safety, performance and costs, whether manufacturing and/or assembling.

Of course, numerous modifications could be made to the above-described embodiments without departing from the scope of the invention as defined in the appended claims.

The invention claimed is:

1. A side rail for mounting onto a patient support assembly, the patient support assembly having a longitudinal x-axis, a transversal y-axis and a vertical z-axis, said axes being mutually orthogonal to each other, the x-axis extending longitudinally along the patient support assembly, from a front portion of the assembly to an opposite rear portion thereof, the y-axis extending transversally across the patient support assembly, from a left side portion of the assembly to an opposite right side portion thereof, and the z-axis extending vertically along the patient support assembly, from a bottom portion of the assembly to an opposite top portion thereof, the side rail extending substantially along the x-axis of the patient support assembly, the side rail being operatively mountable onto a corresponding side portion of the patient support assembly, the side rail comprising:

a first support bar having upper and lower ends, the lower end of the first support bar being pivotally mountable to said corresponding side portion of the patient support assembly;

a second support bar having upper and lower ends, the lower end of the second support bar being pivotally mountable to said corresponding side portion of the patient support assembly; and a plurality of cross bars each having first and second ends pivotally connected to the first and second support bars respectively;

the side rail being operable between a raised configuration where the cross bars are above a segment of the patient support assembly for preventing egress of a patient from said assembly, and a lowered configuration where said cross bars are below said segment of the patient support assembly for allowing egress of the patient from the assembly;

wherein the support bars and the cross bars of the side rail are substantially positioned within a same vertical plane, being substantially parallel to the corresponding side portion of the patient support assembly, and wherein the first and second support bars are rotatable with respect to said corresponding side portion about respective axes being parallel to the y-axis, and the first and second ends of the cross bars are rotatable with respect to the support bars about respective axes being parallel to the y-axis, so that the side rail be operated between the raised and lowered configurations along said same vertical plane and so that the side rail and corresponding cross bars be collapsible in the lowered configuration, within said same vertical plane; and wherein the side rail comprises a pivot bar having first and second ends, the first end of the pivot bar being pivotally mountable about said corresponding side portion of the patient support assembly and being rotatable thereabout about an axis parallel to the y-axis, and the second end of the pivot bar being pivotally connected to the lower end of the second support bar and being rotatable thereabout about an axis parallel to the y-axis, the pivot bar being shaped, positioned and dimensioned so as to prevent the side rail from exceeding a predetermined distance longitudinally along the patient support assembly when operated and collapsed into the lowered configuration.

2. A side rail according to claim 1, wherein the lower end of the first support bar is provided with blocking means cooperable with the patient support assembly, and operable between a blocking configuration where the blocking means are engaged with the assembly and maintain the side rail in a raised configuration, and a release configuration where the blocking means are disengaged from the assembly for allowing the side rail to be operated into a lowered configuration.

3. A side rail according to claim 2, where the blocking means comprise a locking pin having a first extremity insertable into a corresponding hole of an adjacent plate of the assembly, the blocking means being in a blocking configuration when the locking pin is inserted into the hole of the plate, thereby preventing the first support bar from being rotated about the corresponding side portion of the patient support assembly, and the blocking means being in the release configuration when the locking pin is urged away from the hole of the plate, thereby enabling the first support bar to be rotated about the corresponding side portion of the patient support assembly, and to be operated into the lowered configuration.

4. A side rail according to claim 3, wherein the blocking means comprise biasing means operatively connected to the locking pin for biasing the same into the hole of the plate.

5. A side rail according to claim 4, wherein the biasing means, locking pin and plate are positioned, shaped and sized with respect to one another to enable the blocking means to be automatically triggered into the blocking configuration when the side rail is operated back into the raised configuration from an intermediate configuration.

6. A side rail according to claim 5, wherein the locking pin has a second extremity, opposite to the first extremity, provided with a knob for enabling an operator of the assembly to pull on said knob for urging the locking pin away from the hole of the plate.

7. A kit for assembling a side rail for mounting onto a patient support assembly having a longitudinal x-axis, a transversal y-axis and a vertical z-axis, said axes being mutually orthogonal to each other, the x-axis extending longitudinally along the patient support assembly, from a front portion of the assembly to an opposite rear portion thereof, the y-axis extending transversally across the patient support assembly, from a left side portion of the assembly to an opposite right side portion thereof, and the z-axis extending vertically along the patient support assembly, from a bottom portion of the assembly to an opposite top portion thereof, the kit comprising:

a first support bar having upper and lower ends, the lower end of the first support bar being pivotally mountable to a corresponding side portion of the patient support assembly;

a second support bar having upper and lower ends, the lower end of the second support bar being pivotally mountable to said corresponding side portion of the patient support assembly; and a plurality of cross bars each having first and second ends pivotally connectable to the first and second support bars respectively;

once assembled, the side rail extending substantially along the x-axis of the patient support assembly, the side rail being operatively mounted onto said corresponding side portion of the patient support assembly and being operable between a raised configuration where the cross bars are above a segment of the patient support assembly for preventing egress of a patient from said assembly, and a lowered configuration where said cross bars are below said segment of the patient support assembly for allowing egress of the patient from the assembly;

wherein the support bars and the cross bars of each side rail are substantially positioned within a same vertical plane, being substantially parallel to the corresponding side portion of the patient support assembly, and wherein the first and second support bars are rotatable with respect to said corresponding side portion about respective axes being parallel to the y-axis, and the first and second ends of the cross bars are rotatable with respect to the support bars about respective axes being parallel to the y-axis, so that the side rail be operated between the raised and lowered configurations along said same vertical plane and so that the side rail and corresponding cross bars be collapsible in the lowered configuration, within said same vertical plane; and wherein the kit further comprises a pivot bar having first and second ends, the first end of the pivot bar being pivotally mountable about said corresponding side portion of the patient support assembly and being rotatable thereabout about an axis parallel to the y-axis, and the second end of the pivot bar being pivotally connected to the lower end of the second support bar and being rotatable thereabout about an axis parallel to the y-axis, the pivot bar being shaped, positioned and dimensioned so as to prevent the side rail from exceeding a predetermined distance longitudinally along the patient support assembly when operated and collapsed into the lowered configuration.

8. A method of operating a side rail of a hospital bed, the method comprising the steps of:

a) providing the hospital bed of claim 10, with the at least one side rail being in the lowered configuration; and b) rotating the support bars of the at least one side rail within said same vertical plane until triggering the blocking means into a blocking configuration so as to operate said at least one side rail into the raised configuration.

9. A hospital bed having a longitudinal x-axis, a transversal y-axis and a vertical z-axis, said axes being mutually orthogonal to each other, the x-axis extending longitudinally along the hospital bed, from a front portion of the bed to an opposite rear portion thereof, the y-axis extending transversally across the hospital bed, from a left side portion of the bed to an opposite right side portion thereof, and the z-axis extending vertically along the hospital bed, from a bottom portion of the bed to an opposite top portion thereof, the hospital bed comprising:

a base structure extending substantially along the x-axis of the hospital bed, the base frame being movable along at least one of said axes;

a patient support platform also extending substantially along the x-axis of the hospital bed, the patient support platform being operatively connected onto the base structure for receiving a patient thereon and having sections movable about at least one of said axes for assuming different configurations; and at least one side rail also extending substantially along the x-axis of the hospital bed, each side rail being operatively mounted onto a corresponding side portion of the hospital bed, each side rail comprising:

a first support bar having upper and lower ends, the lower end of the first support bar being pivotally mounted to said corresponding side portion of the hospital bed;

a second support bar having upper and lower ends, the lower end of the second support bar being pivotally mounted to said corresponding side portion of the hospital bed; and a plurality of cross bars each having first and second ends pivotally connected to the first and second support bars respectively;

each side rail being operable between a raised configuration where the cross bars are above a segment of the patient support platform for preventing egress of the patient from said platform, and a lowered configuration where said cross bars are below said segment of the patient support platform for allowing egress of the patient from the platform;

wherein the support bars and the cross bars of the side rail are substantially positioned within a same vertical plane, being substantially parallel to the corresponding side portion of the hospital bed, and wherein the first and second support bars are rotatable with respect to said corresponding side portion about respective axes being parallel to the y-axis, and the first and second ends of the cross bars are rotatable with respect to the support bars about respective axes being parallel to the y-axis, so that each side rail be operated between the raised and lowered configurations along said same vertical plane and so that said each side rail and corresponding cross bars be collapsible in the lowered configuration, within said same vertical plane; and wherein each side rail comprises a pivot bar having first and second ends, the first end of the pivot bar being pivotally mounted about said corresponding side portion of the hospital bed and being rotatable thereabout about an axis parallel to the y-axis, and the second end of the pivot bar being pivotally connected to the lower end of the second support bar and being rotatable thereabout about an axis parallel to the y-axis, the pivot bar being shaped, positioned and dimensioned so as to prevent each side rail from exceeding a predetermined distance longitudinally along the hospital bed when operated and collapsed into the lowered configuration.

10. A hospital bed according to claim 9, wherein the lower end of the first support bar is provided with blocking means cooperable with the base structure, and operable between a blocking configuration where the blocking means are engaged with the base structure and maintain the side rail in a raised configuration, and a release configuration where the blocking means are disengaged from the base structure for allowing the side rail to be operated into a lowered configuration.

11. A hospital bed according to claim 10, where the blocking means comprise a locking pin having a first extremity insertable into a corresponding hole of an adjacent plate of the base structure, the blocking means being in a blocking configuration when the locking pin is inserted into the hole of the plate, thereby preventing the first support bar from being rotated about the corresponding side portion of the hospital bed, and the blocking means being in the release configuration when the locking pin is urged away from the hole of the plate, thereby enabling the first support bar to be rotated about the corresponding side portion of the hospital bed, and to be operated into the lowered configuration.

12. A hospital bed according to claim 11, wherein the blocking means comprise biasing means operatively connected to the locking pin for biasing the same into the hole of the plate.

13. A hospital bed according to claim 12, wherein the biasing means, locking pin and plate are positioned, shaped and sized with respect to one another to enable the blocking means to be automatically triggered into the blocking configuration when the side rail is operated back into the raised configuration from an intermediate configuration.

14. A hospital bed according to claim 13, wherein the locking pin has a second extremity, opposite to the first extremity, provided with a knob for enabling an operator of the hospital bed to pull on said knob for urging the locking pin away from the hole of the plate.

15. A hospital bed according to claim 9, wherein said at least one side rail comprises first and second side rails, the first side rail being operatively connected onto the left side portion of the hospital bed, and the second side rail being operatively connected onto the right side portion of the hospital bed.

16. A hospital bed according to claim 9, wherein said at least one side rail comprises first and second pairs of side rails, the first pair of side rails being operatively connected onto the left side portion of the hospital bed, and the second pair of side rails being operatively connected onto the right side portion of the hospital bed, each pair of side rails comprising first and second side rails, the first support bar of each of the first and second side rails being positioned substantially at a midpoint area along the bed and a constant distance being maintained between the first support bars of said first and second side rails when in the raised configuration, irrespectively of configuration assumed by the patient support platform.

17. A method of operating a side rail of a hospital bed, the method comprising the steps of:

a) providing the hospital bed of claim 14, with the at least one side rail being in the raised configuration;

b) pulling on the knob for operating the blocking means into a release configuration; and c) rotating the support bars of the at least one side rail within said same vertical plane so as to operate and collapse said at least one side rail into the lowered configuration.

* * * * *